US007644547B2

(12) United States Patent
Bonshor

(10) Patent No.: US 7,644,547 B2
(45) Date of Patent: Jan. 12, 2010

(54) EXTERIOR SILL

(75) Inventor: Dave Bonshor, Surrey (CA)

(73) Assignee: Tapco International Corporation, Wixom, MI (US)

( * ) Notice: Subject to any disclaimer, the term of this patent is extended or adjusted under 35 U.S.C. 154(b) by 563 days.

(21) Appl. No.: 11/439,030

(22) Filed: May 23, 2006

(65) Prior Publication Data

US 2006/0261636 A1 Nov. 23, 2006

Related U.S. Application Data

(60) Provisional application No. 60/683,448, filed on May 23, 2005.

(51) Int. Cl.
*E06B 7/14* (2006.01)

(52) U.S. Cl. ..... 52/209; 52/204.5; 49/408; 411/531

(58) Field of Classification Search ..... 52/60, 52/97, 204.5–204.55, 208–209, 211, 214, 52/716.2, 717.1, 843, 844, 718.01, 718.04, 52/718.05, 235, 302.1, 656.5, 787.1, 717.01, 52/716.6; 49/408, 467, 469, 471; D25/122, D25/124; 411/531, 160; 174/48, 507, 68.7
See application file for complete search history.

(56) References Cited

U.S. PATENT DOCUMENTS

| | | | | | |
|---|---|---|---|---|---|
| 2,848,766 | A * | 8/1958 | Fulton | 49/469 |
| 3,512,318 | A * | 5/1970 | Turner | 52/100 |
| 3,962,828 | A * | 6/1976 | McAllister | 49/468 |
| 4,380,413 | A * | 4/1983 | Dewey | 411/161 |
| 4,430,830 | A * | 2/1984 | Sailor | 52/211 |
| 4,682,451 | A * | 7/1987 | Hubble | 52/97 |
| 5,001,877 | A * | 3/1991 | Edwards | 52/288.1 |
| D325,992 | S * | 5/1992 | Valentin | D25/124 |
| D338,970 | S * | 8/1993 | Moss et al. | D25/124 |
| 5,622,017 | A * | 4/1997 | Lynn et al. | 52/209 |
| 6,308,475 | B1 * | 10/2001 | Crish et al. | 52/204.597 |
| 6,345,480 | B1 * | 2/2002 | Kemper et al. | 52/395 |
| 6,427,395 | B1 * | 8/2002 | Elsasser et al. | 52/181 |
| 6,786,016 | B1 * | 9/2004 | Wood | 52/290 |
| 7,041,898 | B2 * | 5/2006 | Stempinski et al. | 174/488 |
| D541,953 | S * | 5/2007 | Deleu | D25/122 |
| 7,326,863 | B2 * | 2/2008 | Herzog | 174/480 |
| 2001/0045076 | A1 * | 11/2001 | Boomer | 52/716.1 |
| 2002/0178684 | A1 * | 12/2002 | Barnett | 52/716.1 |
| 2003/0106702 | A1 * | 6/2003 | Seamans et al. | 174/48 |
| 2005/0262798 | A1 * | 12/2005 | Pringle et al. | 52/718.04 |

* cited by examiner

*Primary Examiner*—Richard E Chilcot, Jr.
*Assistant Examiner*—James J Buckle, Jr.
(74) *Attorney, Agent, or Firm*—Howard & Howard Attorneys PLLC

(57) ABSTRACT

An exterior sill assembly preferably for a window has a preferably extruded body, and attachable facial and preferably end caps for covering open ends of a cavity defined by the body. The body has a substantially vertical flange for mounting to a structure preferably below a window frame. A sill projects outward from the flange to a distal portion and preferably a support plate spaced below the sill and projecting outward from the flange to a distal segment. Attachment features are carried between the facial, the distal portion and the distal segment for releasable engagement of the facial to the body. Fasteners disposed in-part in the cavity extend through the flange for engagement into the structure. Preferably, the fasteners are used in conjunction with respective members for distributing stress loads across the flange.

29 Claims, 2 Drawing Sheets

EXTERIOR SILL

RELATED APPLICATIONS

This patent application claims priority to and all advantages of U.S. Provisional Patent Application No. 60/683,448 which was filed on May 23, 2005.

FIELD OF THE INVENTION

The subject invention generally relates to exterior sills and more particularly to extruded window sills.

BACKGROUND OF THE INVENTION

Windows, doors and other openings in exterior structures or walls of buildings are known to have sills or thresholds designed to seal inclement weather out and generally shed water away from the window or opening and prevent moisture ingress between structure underlayment or sheathing and the exterior siding or veneer of the building. Unfortunately, known sills that are made of wood can rot and peel paint over the years, and stone sills are expensive and difficult to install. Both wood and stone sills typically require caulking to prevent water seepage into the structure. Moreover, this caulking requires continual maintenance to reseal old chalk that has cracked or loosened.

SUMMARY OF THE INVENTION AND ADVANTAGES

An exterior sill assembly preferably for a window has a preferably extruded body, and attachable facial and preferable end caps for covering open ends of a cavity defined in-part by the body. The body has a substantially vertical flange for mounting to a structure preferably below a window frame. A sill projects outward from the flange to a distal portion, and preferably a support plate spaced below the sill projects outward from the flange to a distal segment. Releasable attachment features are carried between the facial, the distal portion and the distal segment for engagement of the facial to the body. Fasteners disposed in-part in the cavity extend through the flange for engagement into the structure. Preferably, the fasteners are used in conjunction with respective members for distributing stress loads across the flange.

Preferably, an upper attachment feature is carried between the longitudinally extending distal portion of the sill and an upper edge of the facial and is orientated in such a way that the facial is slightly recessed from a drip edge of the sill that is carried by the distal portion. A lower attachment feature is carried between the longitudinally extending distal segment of the support plate and the facial providing structural support for the sill.

Features, advantages and benefits of the present invention include a maintenance free sill assembly that is easy to install, has improved sealing and water shedding capability, and is relatively inexpensive. Moreover, the sill assembly is robust, relatively simple in design, and in-service has a maintenance-free and long and useful life.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
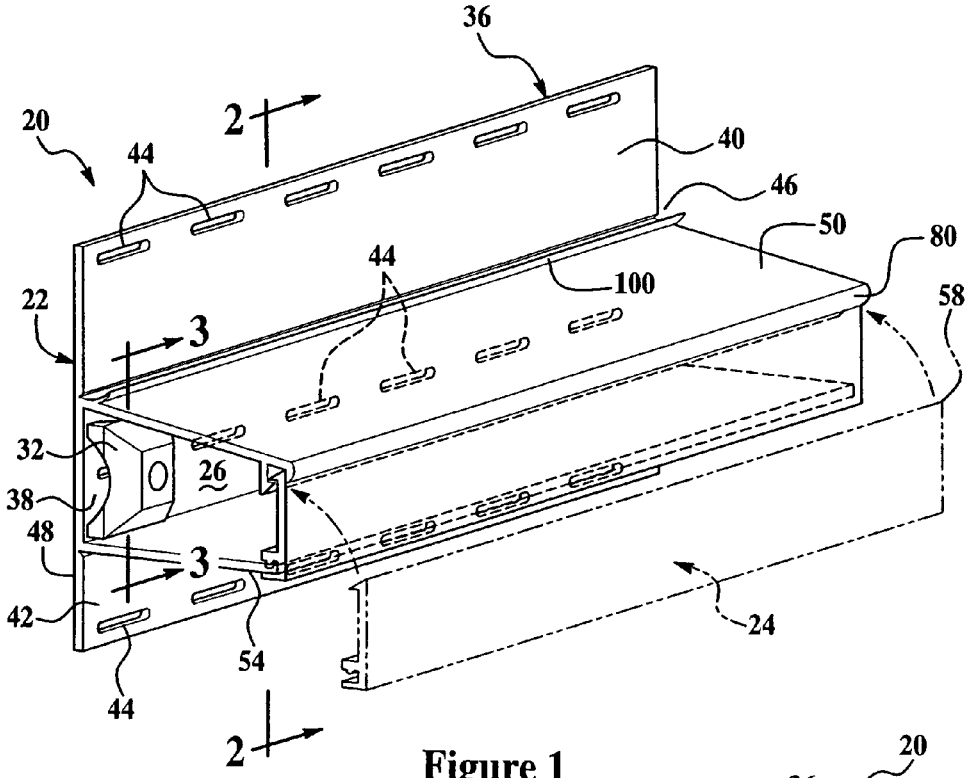
FIG. 1 is an exploded perspective view of a sill embodying the present invention.

As best illustrated in FIGS. 1-4, a sill assembly 20 embodying the present invention and preferably for a window or any other exterior opening in a building or structure has an elongated body 22, an elongated facial 24, a cavity 26 generally defined by the body 22 and the facial 24, and end caps 28 press fitted to the body for covering open ends of the cavity 26. The body 22 and the facial 24 are preferably made of extruded plastic or aluminum. The body 22 and facial 24 are produced in sellable and shippable lengths that are preferably cut to a measured length at the job site to fit the particular window or opening. The width of the body 22 or that portion projecting away from the structure is preferably sufficient to extend beyond the exterior siding or veneers of the building. Securing the body 22 to the structure located beneath the window are a plurality of fasteners 30 that are preferably threaded screws and a respective plurality of stress distribution members 32 engaged generally between an enlarged head 34 of the fasteners 30 and a substantially vertical flange 36 of the body 22.

The flange 36 of the body 22 is preferably elongated in a horizontal direction and spans laterally in a vertical direction. The flange 36 has a base or mid portion 38, a top portion 40, and a bottom portion 42. Each portion 38, 40, 42 has a horizontal row of a plurality of apertures or slots 44 for selective receipt of the fasteners 30. Preferably, the top and bottom portions 40, 42 are engaged to the mid portion 38 via respective living hinges or furrows 46, 48. The furrows 46, 48 create greater flexibility in the flange 36 for conforming to irregularities in the vertical structure and/or for quick removal of the top and/or bottom portions 40, 42 from the body 22 via a repetitious folding of the flange 36 along either of the furrows 46, 48 until the fatigued material breaks or by a saw or blade cut made along the furrows 46, 48.

An elongated sill 50 projects laterally outward from the mid portion 38 of the flange 36 just below the top furrow 46 of the flange 36. As the sill 50 projects forward it also slopes downward to a distal portion 52 that preferably releasably engages the facial 24. Also projecting laterally outward from the mid portion 38, preferably immediately above the furrow 48 and spaced below the sill 50 is a support bracket or elongated plate 54. The plate 54 co-extends longitudinally with the flange 36 and the sill 50, and projects laterally outward to a distal segment 56 that preferably snap fits to the facial 24.

Figure 2:
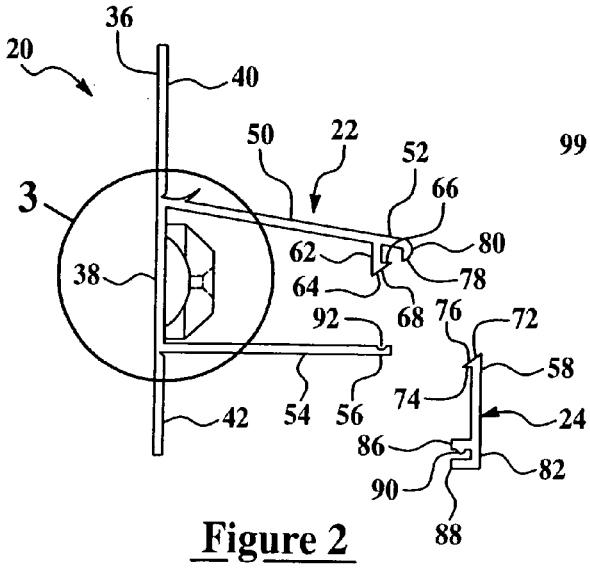
FIG. 2 is an exploded cross section of the sill taken along line 2-2 of FIG. 1.
Figure 4:
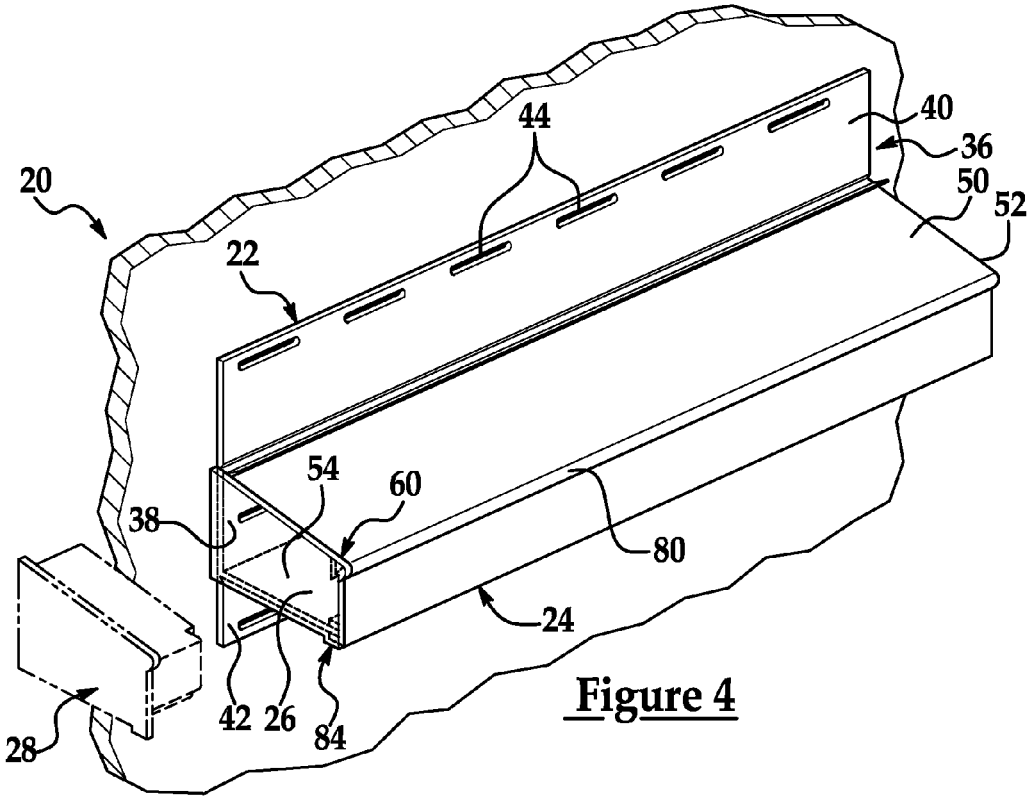
FIG. 4 is an exploded perspective view of the sill.
Figure 5:
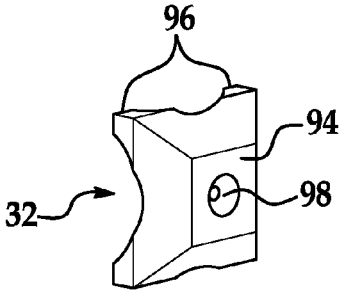
FIG. 5 is a front perspective view of a stress distribution member of the sill.
Figure 6:
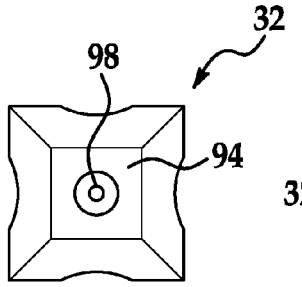
FIG. 6 is a front view of the stress distribution member.
Figure 7:
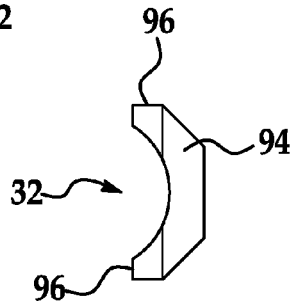
FIG. 7 is a side view of the stress distribution member.
Figure 8:
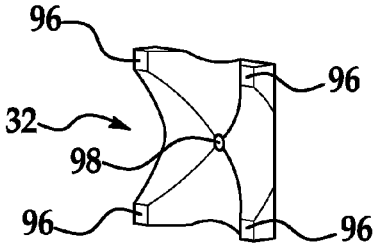
FIG. 8 is a rear perspective view of the stress distribution member.
Figure 9:
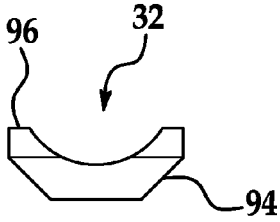
FIG. 9 is a top view of the stress distribution member.

Referring to FIGS. 2 and 4, carried preferably between the distal portion 52 of the sloping sill 50 and a longitudinal upper edge 58 of the facial 24 is a swing joint or upper fastening feature 60. Feature 60 preferably has an arm 62 projecting downward from the distal portion 52 of the sill 50 to an enlarged head 64 that projects forward and away from the structure. The head 64 carries a substantially horizontal stop face 66 that faces upward and a sloped face 68 that faces forward and downward. A longitudinal upper edge 58 of the facial 24 supports a catch 72 of the feature 60 that projects inward with respect to the structure. The catch 72 carries a downward facing stop surface 74 and a slope surface 76 that faces inward and upward. During assembly of the facial 24 to the body 22, sliding contact of the sloped face 68 and the sloped surface 76 guide the catch 72 preferably into a snap fit arrangement over the stop face 66. When assembled, the stop face 66 supported by the sill 50 is in contact with the stop surface 74 supported by the facial 24 thus substantially preventing vertical movement. The feature 60 also has an elongated rib 78 supported by the distal portion 52, spaced forward of the arm 62 and head 64, and projecting laterally downward for preventing forward or releasing movement of the facial 24 once assembled. The rib 78 also carries a rounded drip edge 80 of the sill 50 for shedding of water outward from the facial 24.

Carried preferably between the distal segment 56 of the support plate 54 and a longitudinal lower edge 82 of the facial 24 is a snap fitting attachment feature 84. Feature 84 preferably has a first or top leg 86 projecting inward from the proximity of the lower edge 82 and a second or bottom leg 88 spaced below the top leg 86 by a distance substantially equal to the thickness of the distal segment 56 of the support plate 54. Preferably a rounded protrusion 90 projects downward from the top leg 86 for a snap fit into a recess 92 in the distal segment 56 that is open upward. One skilled in the art would now know that the recess 92 and protrusion 90 can be interchanged for the same snap fit effect. Moreover, the protrusion 90 can be located on the bottom leg 88 with the recess 92 opened downward. One skilled in the art would also now know that the fastening feature 60 and the fastening feature 84 can be interchanged although the configuration illustrated is the preferred for purposes of shedding water from the sill 50.

Referring to FIGS. 3 and 5-9, the stress distribution member 32 has a base portion 94, at least three projecting legs 96 (preferably four legs as illustrated), and a hole 98 in the base portion 94. The four legs 96 are spaced circumferentially from one-another and about the hole 98, and project inward from the base portion 94 for compressive contact with the mid portion 38 of the flange 36 when the fasteners 30 are tightened against the base portion 94. The hole 98 is centered in the member 32 for receipt of a threaded shank 99 projecting inward from the enlarged head 34 of the fastener 30.

Figure 3:
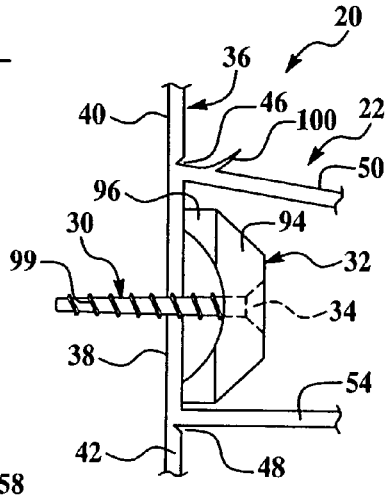
FIG. 3 is a partial cross section of the sill taken along line 3-3 of FIG. 1.

Referring to FIGS. 1 and 3, a resiliently flexible and elongated seal or gasket 100 co-extends longitudinally with the sill 50. The seal 100 projects upward and preferably outward from the sill 50 substantially near the furrow 46 for sealing preferably against an underside of a window casement. During manufacturing of the sill assembly 20, the seal 100 is preferably co-extruded with the body 22. While it is anticipated that the present invention could be made from metal in a stamping or extrusion process, the present invention in its preferred embodiment is intended to be molded or extruded from plastic. The flexible sealing gasket 100 is molded in an upward pointing direction as shown but can be easily compressed to fit tightly to the building component above it, creating a good weather resistant seal. This sealing gasket 100 will be particularly useful in cases where the sill assembly 20 is to be installed underneath an existing window sash where water intrusion is likely to occur. Caulking between the top surface of sill 50 and the building component above it could provide an additional seal.

During installation of the sill assembly 20, the body 22 and the facial 24 are first cut to length for a snug fit into the available opening area of the building. If surrounding structure dictates, the top and bottom portions 40, 42 of the flange 36 are quickly and conveniently removed. The body 22 is then inserted into the opening until flange contact is made with the vertical structure generally located beneath the window. In some applications, the body 22 is also forced upward to bias the seal 100 against the underside of the window casement. The fasteners 30 are then generally coupled with the respective stress distribution members 32, are inserted through selective slots 44 in the mid portion 38, and are screwed into the vertical structure generally beneath the building opening.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that reference numerals are utilized merely for convenience and are not to be limiting in any way, and that the invention may be practiced otherwise than as specifically described.

What is claimed is:

1. A sill assembly comprising:

an elongated mounting flange for attachment to a vertical structure;

an elongated sill co-extending with the mounting flange and projecting laterally outward from the mounting flange to a distal portion;

a support plate spaced below the elongated sill and projecting outward from the elongated mounting flange to a distal segment;

a top portion of the elongated mounting flange disposed above the sill;

a mid portion of the elongated mounting flange disposed between the sill and the support plane;

a fascia co-extending with and projecting laterally downward from the sill to the support plate; and a first attachment feature carried between the distal portion and the sill for connecting the fascia to the sill after the mounting flange is attached to the vertical structure;

wherein the elongated sill includes a drip edge spaced from the elongated mounting flange further than the fascia and wherein the fascia is spaced from the elongated mounting flange further than the distal segment of the support plate for shedding water outward of the fascia.

2. The sill assembly set forth in claim 1 wherein the mounting flange projects laterally beneath the sill.

3. The sill assembly set forth in claim 2 further comprising a fastener extending through the mounting flange beneath the sill and into the vertical structure.

4. The sill assembly set forth in claim 3 further comprising:

a stress distribution member disposed between the mounting flange and an enlarged head of the fastener; and a hole in the stress distribution member, wherein a shank of the fastener projects from the enlarged head through the hole, through the mounting flange and into the vertical structure.

5. The sill assembly set forth in claim 4 further comprising:

a base portion of the stress distribution member having the hole; and at least three legs of the stress distribution member spaced circumferentially about the hole, projecting from the base portion to distal ends being in contact with the mounting flange.

6. The sill assembly set forth in claim 3 wherein the elongated support plate co-extends with the sill and is attached to the fascia.

7. The sill assembly set forth in claim 6 further comprising:

an elongated cavity defined by the mounting flange, the support plate, the sill and the fascia, the cavity having an open end; and an end cap extending into the cavity at the open end and abuts the sill and the fascia for covering the open end.

8. The sill assembly set forth in claim 6 further comprising a second attachment feature carried between fascia and the distal segment.

9. The sill assembly set forth in claims wherein the first attachment feature is a releasable swing joint and the second attachment feature provides a snap fit.

10. An exterior sill assembly for a window installed over a vertical structure, the sill assembly comprising:

an elongated extruded body having an elongated flange laterally extending vertically;

a support plate projecting outward from the flange and away from the structure to a distal segment;

an elongated sill projecting outward from the flange, away from the structure and spaced above the support plate to a distal portion;

an elongated fascia co-extending longitudinally with the support plate and the sill;

a swing joint carried between the fascia and one of the distal segment and the distal segment;

wherein the elongated sill includes a drip edge spaced from the elongated mounting flange further than the elongated fascia and wherein the elongated fascia is spaced from the elongated flange further than the distal segment of the support plate for shedding water outward of the fascia;

a top portion of the elongated flange disposed above the sill; and a mid portion of the elongated flange disposed between the sill and the support plane.

11. The exterior sill assembly set forth in claim 10 further comprising an elongated furrow in the top portion and near the sill for detaching the top portion from the extruded body.

12. The exterior sill assembly set forth in claim 11 further comprising a bottom portion of the elongated flange disposed below the support plate.

13. The exterior sill assembly set forth in claim 10 further comprising an elongated and resiliently flexible seal co-extending longitudinally with the sill and projecting upward from the sill and in the proximity for the flange of yieldable contact with a bottom of a window frame.

14. The exterior sill assembly set forth in claim 10 wherein the swing joint is carried in-part by the distal portion and the snap fit attachment feature is carried in-part by the distal segment.

15. The exterior sill assembly set forth in claim 14 further comprising:

an arm of the swing joint projecting downward from the distal portion to an enlarged head projecting forward and away from the structure;

a rib of the swing joint disposed forward of the arm and the enlarged head and projecting downward from the distal portion; and a catch of the swing joint formed to a top edge of the fascia and projecting toward the structure and fitted above the enlarged head.

16. The exterior sill assembly set forth in claim 15 further comprising:

a first leg of the attachment feature projecting inward from the fascia; and a second leg of the attachment feature projecting inward from the fascia and spaced below the first leg wherein the distal segment of the support plate is fitted between the first and second legs.

17. The exterior sill assembly set forth in claim 10 further comprising:

a first leg of the attachment feature projecting inward from the fascia and having one of a protrusion and a recess facing one of the distal segment and the distal portion; and the one of the distal segment and the distal portion carrying the other of the protrusion and the recess for snap engagement of the protrusion into the recess.

18. The sill assembly set forth in claim 10 further comprising a bottom portion of the elongated flange disposed below the support plate.

19. A sill assembly comprising:

a mounting flange for attachment to a vertical structure;

a sill extending from and transverse to the mounting flange to a distal portion;

a support plate spaced from the sill and extending from the transverse to the mounting flange to a distal segment; and a fascia spaced from the mounting flange and extending from the sill to the support plate;

the mounting flange having a mid portion extending from the sill to the support plate, a top portion extending upwardly from the mid portion, and a bottom portion spaced from the top portion and extending downwardly from the mid portion;

the mounting flange defining a furrow between the mid portion and at least one of the top portion and the bottom portion for selectively flexing to conform to irregularities in the vertical structure and for selectively separating the top and/or bottom portion from the mid portion along the furrow;

wherein the sill includes a drip edge spaced from the mounting flange further than the fascia and wherein the fascia is spaced from the mounting flange further than the distal segment of the support plate for shedding water outward of the fascia.

20. The sill assembly as set forth in claim 19 wherein the mounting flange defines one furrow between the mid portion and the top portion adjacent the sill and defines another furrow between the mid portion and the bottom portion adjacent the support plate.

21. The sill assembly as set forth in claim 19 wherein the mid portion, the top portion, and the bottom portion are coplanar.

22. The sill assembly as set forth in claim 19 further comprising a first attachment feature carried between the distal portion and the sill for connecting the fascia to the sill after the mounting flange is attached to the vertical structure and a second attachment feature carried between fascia and the distal segment.

23. The sill assembly as set forth in claim 22 wherein one of the first and second attachment features is a releasable swing joint and the other of the first and second attachment features provides a snap fit.

24. A sill assembly comprising:

a mounting flange for attachment to a vertical structure;

a sill extending from and transverse to the mounting flange to a distal portion; a support plate spaced from the sill and extending from and transverse to the mounting flange to a distal segment; and a fascia spaced from the mounting flange and extending from the sill to the support plate; and a resiliently flexible gasket extending upwardly from the sill adjacent to and along the mounting flange for sealing against an underside of a window casement; wherein the mounting flange, the support plate, the sill and the fascia define a cavity having spaced open ends; end caps extending into the cavity at the open ends and abutting the sill and the fascia for covering the open ends.

25. The sill assembly as set forth in claim 24 wherein the mounting flange includes a mid portion extending from the sill to the support plate and a top portion extending upwardly from the mid portion wherein the mounting flange defines a furrow between the mid portion and the top portion for selectively flexing to conform to irregularities in the vertical structure and for selectively separating the top and/or bottom portion from the mid portion along the furrow.

26. The sill assembly as set forth in claim 25 wherein the resiliently flexible gasket is adjacent the furrow.

27. The sill assembly as set forth in claim 24 wherein the resiliently flexible gasket extends from one of the open ends to the other of the open ends.

28. The sill assembly as set forth in claim 24 wherein the sill has a bottom side defining in-part the cavity and a top side opposite the bottom side and wherein the resiliently flexible gasket extends from the top side.

29. An exterior sill assembly for a window installed over a vertical structure, the sill assembly comprising:

an elongated extruded body having an elongated flange laterally extending vertically;

a support plate projecting outward from the flange and away from the structure to a distal segment;

an elongated sill projecting outward from the flange, away from the structure and spaced above the support plate to a distal portion;

an elongated fascia co-extending longitudinally with the support plate and the sill;

a swing joint carried between the fascia and one of the distal segment and the distal segment;

wherein the elongated sill includes a drip edge spaced from the elongated mounting flange further than the elongated fascia and wherein the elongated fascia is spaced from the elongated flange further than the distal segment of the support plate for shedding water outward of the fascia;

a first leg of the attachment feature projecting inward from the fascia and having one of a protrusion and a recess facing one of the distal segment and the distal portion; and the one of the distal segment and the distal portion carrying the other of the protrusion and the recess for snap engagement of the protrusion into the recess.

* * * * *

UNITED STATES PATENT AND TRADEMARK OFFICE

CERTIFICATE OF CORRECTION

PATENT NO. : 7,644,547 B2
APPLICATION NO. : 11/439030
DATED : January 12, 2010
INVENTOR(S) : Dave Bonshor It is certified that error appears in the above-identified patent and that said Letters Patent is hereby corrected as shown below:

Column 8, Claim 9, line 1, "claims" should read -- claim 8 --.

Signed and Sealed this

Twenty-third Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,644,547 B2
APPLICATION NO. : 11/439030
DATED : January 12, 2010
INVENTOR(S) : Dave Bonshor It is certified that error appears in the above-identified patent and that said Letters Patent is hereby corrected as shown below:

Column 5, Claim 9, line 9, "claims" should read -- claim 8 --.

This certificate supersedes the Certificate of Correction issued February 23, 2010.

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,644,547 B2
APPLICATION NO. : 11/439030
DATED : January 12, 2010
INVENTOR(S) : Dave Bonshor It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 676 days.

Signed and Sealed this

Sixteenth Day of November, 2010

David J. Kappos

David J. Kappos
*Director of the United States Patent and Trademark Office*